United States Patent [19]

Raymond

[11] 4,108,378

[45] Aug. 22, 1978

[54] RAILROAD TIE AND TIE PLATE WITH COACTING GROOVES AND PROJECTIONS THAT PREVENT SPIKE KILLING OF THE TIES

[76] Inventor: Roger Raymond, 720 Leclerc St., Acton Vale, Canada

[21] Appl. No.: 785,414

[22] Filed: Apr. 7, 1977

[51] Int. Cl.[2] ..... E01B 13/02

[52] U.S. Cl. ..... 238/298; 238/45

[58] Field of Search ..... 238/29, 30, 45, 287, 238/297, 298

[56] References Cited

U.S. PATENT DOCUMENTS

| | | | |
|---|---|---|---|
| 1,073,773 | 9/1913 | Mc Gonigal | 238/298 |
| 1,669,440 | 5/1928 | Bell et al. | 238/298 |
| 2,038,919 | 4/1936 | Boyce | 238/298 |
| 2,357,629 | 9/1944 | Cantrell et al. | 238/287 |
| 3,055,590 | 9/1962 | Mitman | 238/287 |
| 3,544,006 | 12/1970 | Pennino | 238/287 |

*Primary Examiner*—Drayton E. Hoffman
*Assistant Examiner*—Carl Rowold

[57] ABSTRACT

A railroad tie and an assembly thereof with at least one tie plate wherein the wooden tie has rabbetted recesses formed in the top face thereof to receive the tie plates and these recesses are characterized by each having precut or machined grooves for receiving ridges projecting from the bottom of the tie plate. The assembly includes a wooden tie having a rabbetted recess formed in the top face and adjacent each end thereof, each recess has a flat intermediate face having a pair of grooves machined or precut therein and laterally spaced from each other lengthwise of the tie, and a tie plate seating in each recess and having a pair of ridges projecting from the bottom thereof and engaging into the corresponding grooves.

2 Claims, 2 Drawing Figures

RAILROAD TIE AND TIE PLATE WITH COACTING GROOVES AND PROJECTIONS THAT PREVENT SPIKE KILLING OF THE TIES

This invention relates to a railroad tie and to a railroad tie and tie plate assembly.

The railroad tie and tie plate assembly now currently used comprises a railroad tie of wood including a top face and a pair of rabbetted recesses formed in the top face to each form a seat for a tie plate. Each recess has so far been formed with a flat bottom face on which the tie plate is fixed and this tie plate is provided with a pair of ridges projecting from the bottom thereof and adapted to sink into the wood of the flat bottom face to firmly anchor the tie plate. Such assembly becomes loose after a while and induces splitting of the tie and is therefore not completely satisfactory.

It is an object of the present invention to provide a railroad tie and an assembly wherein grooves are machined or precut in the intermediate face of each recess to recline the ridges at the bottom of the tie plates and to thus avoid the disadvantages inherent to forcing these ridges into the bottom face of the recesses.

It is another object of the present invention to provide a tie and tie plate assembly which avoids splitting the wood of the tie and yet ensures a tight anchoring of the tie plate in the corresponding recess.

Figure 1:
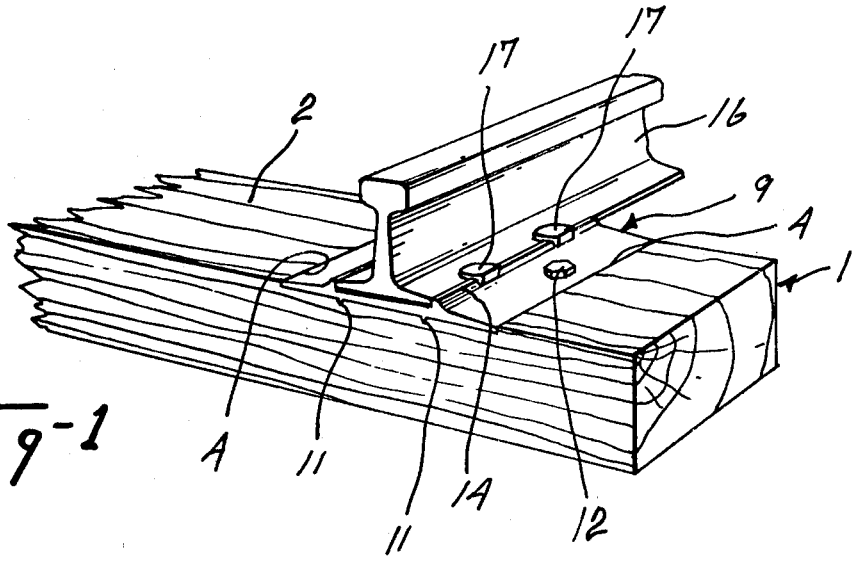
Figure 2:
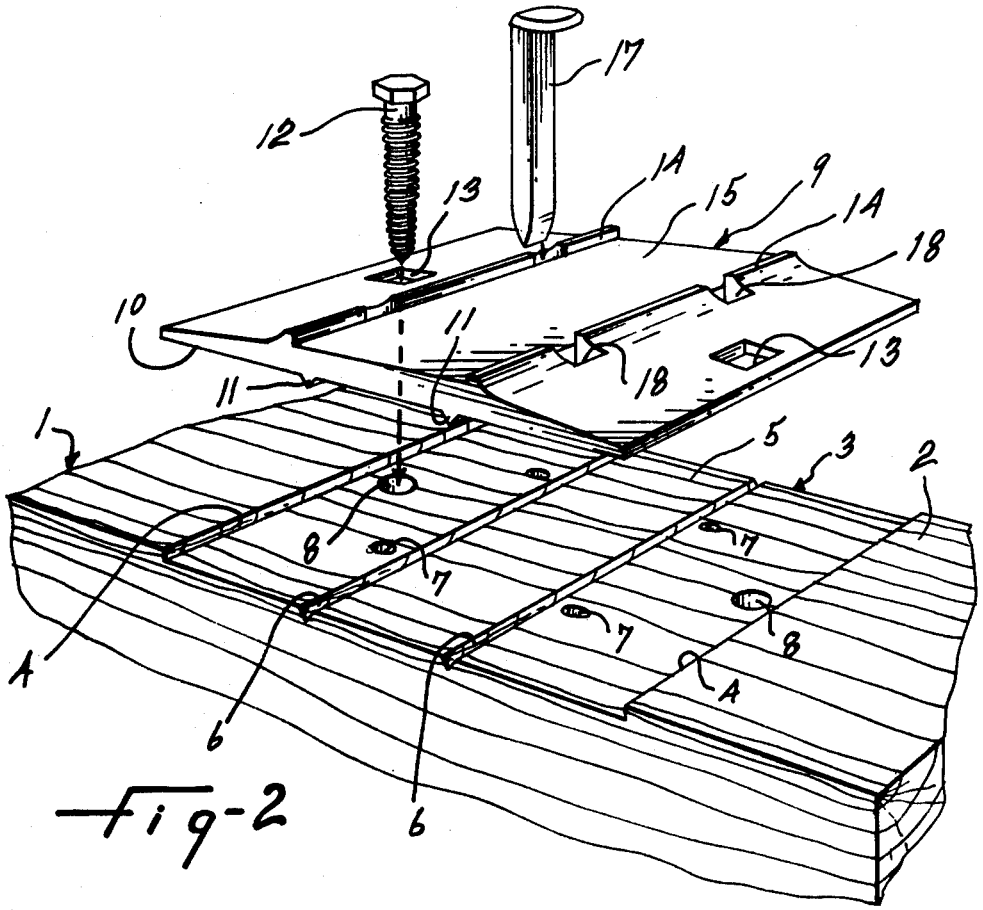

The above and other objects and advantages of the present invention will be better understood with reference to the following detailed description of a preferred embodiment thereof which is illustrated, by way of example, in the accompanying drawing, in which:

FIG. 1 is a perspective view of one end of a railroad tie and a tie plate forming an assembly according to the present invention; and FIG. 2 is an exploded perspective view of the elements shown in FIG. 1.

The illustrated railroad tie and tie plate assembly includes a wood tie 1, of conventional size and rectangular configuration. The railroad tie 1 has top face 2 formed with a pair of rabbetted recesses 3 adjacent the opposite ends thereof respectively. Since only one end of the tie 1 is shown in the drawing, only one recess 3 can be seen. Recess 3 is shallow and rectangular and extends transversely of the tie. This shallow recess defines a pair of shoulders 4 extending orthogonally to the bottom face 5 of recess 3 and to the length of the tie. Bottom face 5 is flat and extends between the two shoulders 4.

A pair of grooves 6 are precut, or machined, in the flat bottom face. The two grooves 6 of each recess 3 extend lengthwise transversely of the tie 1 and are laterally spaced from each other a predetermined distance and lengthwise of the tie. Holes 7 and 8 are drilled in the tie in predetermined spaced-apart relationship one to the other in relation with the tie plate 9.

The railroad tie and tie plate assembly according to the present invention includes a railroad tie 1 as aforedescribed and a pair of tie plates 9 seating in the two corresponding recesses 3 of the tie.

Each tie plate 9 is made of metal and includes a generally flat underface 10 and a pair of ridges 11 projecting from the generally flat underface 10. The two ridges 11 of each tie plate 9 extend substantially parallel to the side edges of tie plate 9 and transversely of the tie 1, and are appropriately dimensioned and laterally spaced apart to sit and fit in the corresponding grooves 6 upon seating the tie plate on the bottom face 5 of recess 3. For this purpose, the distance between the side edges of tie plate 9 is substantially equal to the distance between shoulders 4. Also, the distance between the respective ridge 11 and the adjacent side edge of the tie plate 9 is substantially equal to the distance between the respective groove 6 and the adjacent shoulder 4 of the recess 3.

The tie plate 9 is fixed in place by a pair of wood screws 12 engaged each in an aperture 13 of the tie plate and screwed in a corresponding bore 8 in the tie 1. The installation of the tie plates 1 at both ends of each tie is best done in the shop. The side edges of the tie plate 9 respectively abut against a shoulder 4.

The tie plate 9 also includes a pair of ribs 14 extending lengthwise transversely of the tie and laterally spaced apart from each other longitudinally of the tie. Ribs 14 serve to position the sole of rail 16 on the central surface portion 15 of the top surface of tie plate 9.

Central surface portion 15 extends between the two corresponding ribs 14 and is inclined inward from the external rib to the internal rib. The rail 16 is secured on the inclined central surface portion 15 by the conventional spikes 17 extending through apertures 18 made through ribs 14 of tie plate 9 and in the holes 7 of the tie 1. The top surface of tie plate 9 further includes on each side of central surface portion 15 a marginal surface portion which is downwardly inclined from central surface portion 15 toward the respective side edge and merging with the latter. Thus, tie plate 9 is thicker in the zone of central surface portion 15 than at the side edges. The depth of recess 6 is substantially equal to the thickness of the side edges of tie plate 9, so that, when the latter sits in recess 6, the zones of the inclined marginal surface portions adjacent the side edges of the tie plate 9 are substantially flush with the top face 2 of the tie 1, while central surface portion 15 is at a higher level than top face 2. The tie plate 9 is firmly held in position on the tie against lateral stresses by the combined action of the ridges 11 fitting precut grooves 6 and the side edges of the tie plate abutting against shoulders 4. Even if a play develops between the rail sole and the spike heads, the tie plate remains firmly seated on bottom face 5 of recess 3 due to the presence of wood screws 12.

What I claim is:

1. A railroad tie and tie plate assembly comprising, in combination, a wood tie having a top face and a pair of spaced rabbetted shallow recesses formed into said top face, each recess having a flat bottom surface intermediate a pair of substantially parallel straight shoulders extending substantially orthogonally to said bottom surface and to the length of said wood tie, said bottom surface further having a pair of pre-cut straight grooves made therein, substantially parallel to said shoulders and spaced from each other and from said shoulders, and for each recess, a tie plate made of metal and having a flat underface, straight and parallel side edges and a top surface defining a central surface portion and on each side of said central surface portion a marginal surface portion downwardly inclined from said central surface portion toward the respective side edge and merging with the latter, said tie plate being thicker in the zone of said central surface portion than at said side edges, and further having a pair of spaced parallel ribs integral with said tie plate and upstanding from said top face at the junction of said central surface portion with the respective marginal surface portion, said ribs being substantially parallel with said side edges and adapted to position the sole of a rail resting on said central surface portion, and a pair of straight, spaced parallel ridges integrally formed with said tie plate and protruding from the underface thereof, and complementary to said grooves, the distance between said side edges being substantially equal to the distance between said shoulders and the distance between the respective ridges and the adjacent side edge of said tie plate being substantially equal to the distance between the respective groove and the adjacent shoulder of said recess, so that said tie plate fits said recess and said ridges fit said grooves without any appreciable lateral play with said underface flat against said bottom surface of said recess, the depth of said recess being substantially equal to the thickness of said side edges, so that the zone of said respective marginal surface portions adjacent said side edges are substantially flush with the top face of said wood tie in their zone adjacent the respective side edges, and said central surface portion is at a higher level than that of said top face of said wood tie, and said tie plate further including spike-receiving apertures made therethrough and extending through the respective ribs.

2. An assembly as claimed in claim 1, wherein said tie plate has additional apertures extending therethrough close to the respective side edges and wood screws extending through said additional apertures and firmly retaining said tie plate in seated engagement within said recess.

* * * * *